US006061830A

United States Patent [19]

Geller

[11] Patent Number: 6,061,830

[45] Date of Patent: May 16, 2000

[54] FABRIC COSTUME WITH EXTERIOR MOLDED FLEXIBLE THREE-DIMENSIONAL COMPONENTS FOR PARTIALLY RECEIVING AND MASKING AT LEAST ONE BODY PORTION

[75] Inventor: Alan Geller, Sea Cliff, N.Y.

[73] Assignee: Easter Unlimited, Inc., Carle Place, N.Y.

[21] Appl. No.: 09/245,491

[22] Filed: Feb. 5, 1999

[51] Int. Cl.[7] ..... A41B 1/12; A41D 1/12; A41D 19/00

[52] U.S. Cl. ..... 2/69; 2/159

[58] Field of Search ..... 2/69, 158, 159, 2/160, 244, 246; 428/16, 17; 441/104, 26; 446/26, 27, 28; D2/741; 623/7, 10, 27, 32, 57

[56] References Cited

U.S. PATENT DOCUMENTS

| | | |
|---|---|---|
| D. 329,321 | 9/1992 | Ringwood . |
| 3,382,504 | 5/1968 | Barbosa . |
| 4,531,919 | 7/1985 | Ware . |
| 4,710,979 | 12/1987 | Bull et al. . |
| 4,723,323 | 2/1988 | Wright, Jr. . |
| 4,732,991 | 3/1988 | Schmid . |
| 4,768,234 | 9/1988 | Yamamoto . |
| 4,772,503 | 9/1988 | Donsky . |
| 4,781,934 | 11/1988 | Pauley . |
| 4,815,149 | 3/1989 | Erhardt et al. . |
| 4,837,864 | 6/1989 | Thill . |
| 5,048,123 | 9/1991 | Monson . |
| 5,079,778 | 1/1992 | Sloot . |
| 5,136,726 | 8/1992 | Kellin et al. . |
| 5,210,881 | 5/1993 | Stocker, Jr. et al. . |
| 5,369,257 | 11/1994 | Gibbon . |
| 5,542,122 | 8/1996 | Moldovan . |
| 5,715,539 | 2/1998 | Benecki et al. . |
| 5,718,589 | 2/1998 | McCracken et al. . |
| 5,742,939 | 4/1998 | Williams . |
| 5,747,144 | 5/1998 | Beige et al. . |

*Primary Examiner*—John J. Calvert
*Assistant Examiner*—Shirra L. Jenkins
*Attorney, Agent, or Firm*—Lackenbach Siegel Marzullo Aronson & Greenspan, P.C.

[57] ABSTRACT

A multi-component costume for at least partially masking a contoured anterior portion of the body includes a first component consisting of a fabric foundation garment for receiving and substantially fully covering the contoured body portion. The second component consists of at least one molded flexible three-dimensional member configured to at least partially receive and cover or mask an anterior surface of the contoured body portion. The second component defines an external, generally convex surface provided with exterior decoration to simulate a desired appearance and an interior generally concave surface forming a three-dimensional cavity having a configuration substantially corresponding to a portion of the contoured body intended or desired to be covered or masked. At least a portion of the fabric foundation garment normally covering the contoured body portion intended or desired to be covered or masked is attached to the interior generally concave surface, such as with adhesive. The molded flexible three-dimensional member closely follows the wearer's contoured body portion to provide the appearance that the exterior decoration corresponds to the exterior surface of the wearer's contoured body portion, while the fabric foundation garment serves to enhance the comfort to the wearer by serving as an intermediate barrier that prevents contact between the skin of the wearer and the molded flexible member.

23 Claims, 3 Drawing Sheets

FABRIC COSTUME WITH EXTERIOR MOLDED FLEXIBLE THREE-DIMENSIONAL COMPONENTS FOR PARTIALLY RECEIVING AND MASKING AT LEAST ONE BODY PORTION

BACKGROUND OF THE INVENTION

1. Field of the Invention

This invention relates to costumes and, more specifically, to a fabric costume with exterior molded flexible three-dimensional components for partially receiving and masking at least one body portion and the method for making the same.

2. Description of the Prior Art

One of the primary purposes of costumes is to realistically masquerade the appearance to observers of those who are wearing the costumes. This is true whether the costumes are used in a theatrical production, a masquerade party, on Halloween or other occasions. However, in order for a costume to be totally viable, it must not only simulate the appearance that is sought to be projected but it must also be easy to use and comfortable to wear. Unfortunately, many costumes, particularly the ones that seek to simulate facial features or the skin of other body parts, are made of a thin flexible plastic or rubber materials. Those costumes made of paper stock are generally not as realistic as the flexible molded rubber counterparts. However, flexible plastic or rubber materials have disadvantages. Being nonporous, costumes made of such rubber materials, such as latex, do not allow for transfer of air and moisture through the costume, and this results in a build-up of humidity inside the costume, which becomes very uncomfortable to the wearer. Also, because such rubber costumes have surfaces that exhibit friction, it is sometimes difficult for the user to slip into the costume, much the same way as it is difficult to insert a hand into a rubber glove.

With most costumes, it is merely important that the costume project the desired appearance to an observer on one line of view, typically, to the front of the wearer. Therefore, if an observer views the front of the person wearing the costume, it is normally sufficient that the costume only include front decorated components. However, nevertheless it is important that the costume surround the user sufficiently, in a three-dimensional space, so as to be as realistic as possible since the observer can view the user in three-dimensions and the line of observation may not be perfectly frontal. Particularly with some costumes, therefore, it is important that the costume surround all observable regions of the wearer, even if this means covering or at least partially enclosing those portions of the user's body which may naturally flex or exhibit relative movements. The costume, in order to be viable, must allow the wearer to move his or her body parts, such as arms, legs, torso, etc., while retaining a credible representation of what the costume purports to represent. Therefore, if the costume is in the form of a glove that covers the hand and is intended to simulate a certain appearance of the skin of the user, the wearer of the costume needs to be able to move the hand and flex the fingers in a normal way to appear more realistic.

In U.S. Pat. No. 5,747,144, a costume is described which has semi-rigid components that can be sewn to fabric to form an integrated costume. Semi-rigid components are formed by fusing a fabric layer to a layer of foam to create a laminate that is vacuum molded into a three-dimensional shape. The patent teaches that after the molded components are formed, they can be sewn together with other fabric sections to form a full costume. However, this costume is somewhat complex and expensive to manufacture. Additionally, the semi-rigid components are not intended to be flexed or significantly deformed during use. Being semi-rigid, the components formed in accordance with the teachings in this patent are clearly intended to cover only those parts of the body which do not experience significant movements, such as the arms, hands, legs, etc. As such, the semi-rigid components of this patent exhibit the same lack of pliability or flexibility that severely limits the extent to which such a costume can be used to cover different body parts. The patent is, accordingly, primarily concerned with a vacuum molded costume component that covers the upper torso.

In U.S. Pat. No. 5,742,939, a play costume is disclosed with attachable pads. A fabric garment, in the form of a body suit, includes sections that are attachable by means of hook and loop tape. The entire body of the user is within the fabric garment and the pads are detachably mounted on the surface portion of the body, including the torso, arms, and legs. However, the individual attachable pads are not intended to be significantly deformed to conform to the shape of the body part being covered.

In U.S. Pat. No. 4,815,149, a T-shirt is disclosed that includes a fabric layer in which there are attached three-dimensional molded articles to provide a three-dimensional relief pattern on a part of the T-shirt. However, the pattern is attached to the outer surface of the fabric layer. Thus, the molded objects are attached at selected depressions or points which are in contact with the fabric layer. See also U.S. Pat. No. 4,837,864, which also discloses an article of clothing with a three-dimensional applique mounted on the surface of the fabric layer. Similar disclosures are contained in the following U.S. Pat. Nos. 4,710,979; 4,723,323; 5,136,726; 5,210,881; and 5,718,589.

In U.S. Pat. Nos. 5,715,539 and 4,768,234, two glove constructions are disclosed. In the first mentioned patent, flexible magnetic strips are attached to the inside (palm side) of a glove to improve the grip. In the latter patent, protective segments are secured to the top surfaces of the glove to protect the hands of a skier. However, neither of these patents discloses three-dimensional segments so formed that the underlying fabric adheres to an interior cavity of a molded product to give the appearance that the hand of the user is actually contained within a three-dimensional molded object while providing maximum comfort in applying the costume. In each case, instead, a three-dimensional object clearly has the appearance of being raised above the surface of the hand.

SUMMARY OF THE INVENTION

Accordingly, it is an object of the present invention to provide a multi-component costume for at least partially masking a contoured anterior portion of the body which overcomes the disadvantages of known costumes.

It is another object of present invention to provide a multi-component costume which is realistic by generally closely following the contours of the part of the body on which the costume is worn.

It is still another object of the present invention to provide a multi-component costume as in the previous objects which is simple in construction and economical to manufacture.

It is yet another object of the present invention to provide a multi-component costume of the type under discussion which is easy to put on and remove.

It is a further object of the present invention to provide a multi-component costume as in the previous objects which allows the body to perspire by providing at least a surface portion covering the body to be porous.

It is still a further object of the present invention to provide a fabric costume with exterior molded flexible three-dimensional components for partially receiving and masking at least one body portion.

It is yet a further object of the present invention to provide a costume of the type under discussion which can be used to cover and mask one or more parts of the wearer's body, including the head, torso, hands, arms and legs.

It is still an additional object of the present invention to provide a costume with exterior molded flexible components which generally conform to the shape of the body part being covered while not contacting the skin of the wearer.

In order to achieve the above objects, as well as others which will become apparent hereinafter, a multi-component costume in accordance with the present invention serves to at least partially mask a contoured anterior portion of the body. The costume comprises a first component consisting of a foundation garment for receiving and substantially fully covering a contoured body portion. A second component consists of at least one molded flexible three-dimensional member configured to at least partially receive and cover or mask an anterior surface of the contoured body portion. The second component defines an external generally convex surface provided with exterior decoration to simulate a desired appearance and an interior generally concave surface forming a three-dimensional cavity having a configuration substantially corresponding to a portion of the contoured body intended or desired to be covered or masked. Attachment means is provided for attaching at least a portion of the fabric foundation garment normally covering the contoured body portion intended or desired to be covered or masked to said interior generally concave surface. In this manner, said molded flexible three-dimensional member closely the wearer's contoured body portion to provide the appearance that said exterior decoration corresponds to the exterior surface of the wearer's contoured body portion while said fabric foundation garment serves to enhance the comfort to the wearer by serving as an intermediate barrier that prevents contact between the skin of the wearer and said molded flexible member.

BRIEF DESCRIPTION OF THE DRAWINGS

The features and advantages of the present invention will become apparent from the following description of the invention, taken together with the accompanying drawings, in which.

DESCRIPTION OF THE PREFERRED EMBODIMENTS

Figure 1:
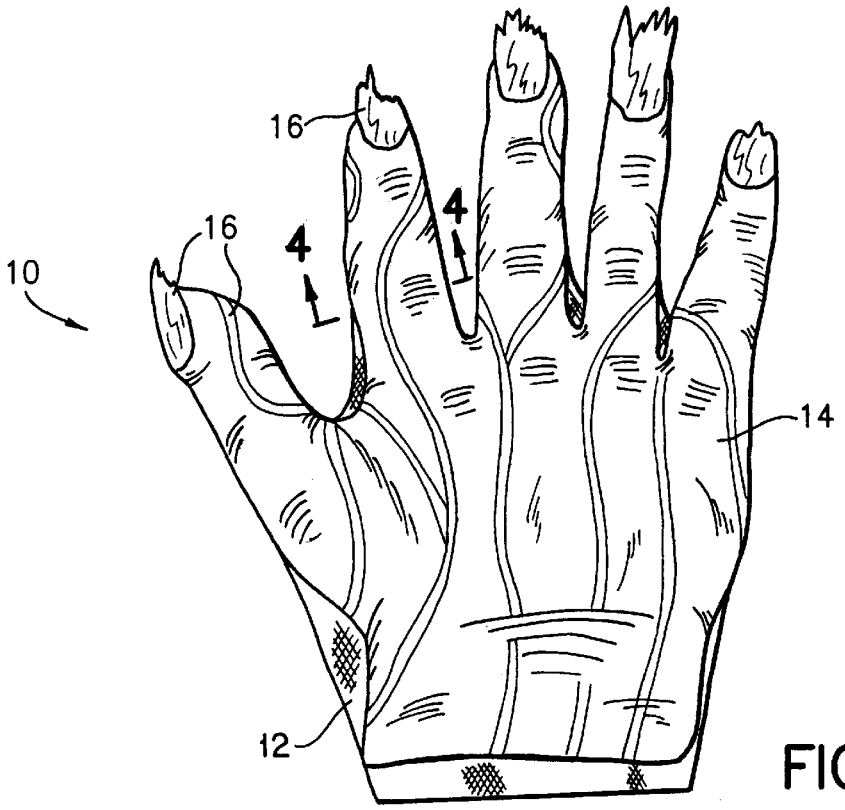
FIG. 1 is a top plan view of a multi-component costume in the form of a glove that incorporates the features of the present invention.

Referring now specifically to the figures, in which similar or identical parts will be designated by the same reference numerals throughout, and first referring to FIG. 1, a multi-component contume for at least partially masking the contoured anterior portion of the body is generally designated by the reference numeral 10.

Figure 4:
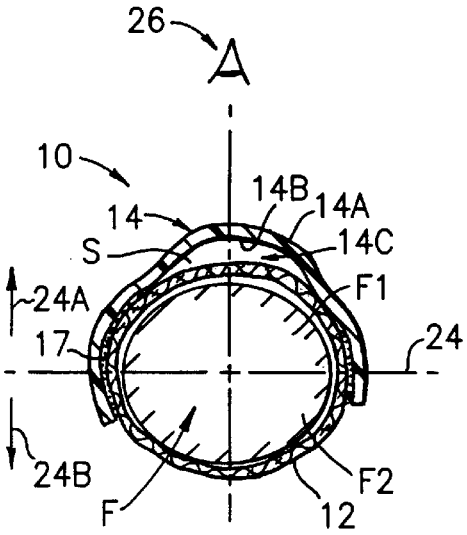
FIG. 4 is a cross sectional view of the glove shown in FIG. 1, taken along line 4—4, in a hand extended condition, illustrating the relative positions of the component parts of the glove as well as the position of the finger within the glove.

In the example illustrated in FIG. 1, the costume is in the form of a glove for covering a human hand. Also referring to FIG. 4, the glove 10 includes a first component which is in the form of a fabric foundation garment 12 for receiving and substantially fully covering a contoured body portion—in this instance, the hand of the user. A second component 14 consists of at least one molded flexible three-dimensional member configured to at least partially receive and cover or mask an anterior surface of the contoured body portion. As shown in FIG. 4, the second component 14 defines an external generally convex surface 14*a* provided with exterior surface decoration 16 to simulate a desired appearance and an interior general concave surface 14*b* forming a three-dimensional cavity 14*c* having a configuration substantially corresponding to a portion of the contoured body, here the hand, intended or desired to be covered or masked.

An attachment mechanism 17 is provided for attaching at least a portion of the fabric foundation garment 12 normally covering the contoured body portion intended or desired to be covered or masked to the interior generally concave surface 14*b*.

Figure 2:
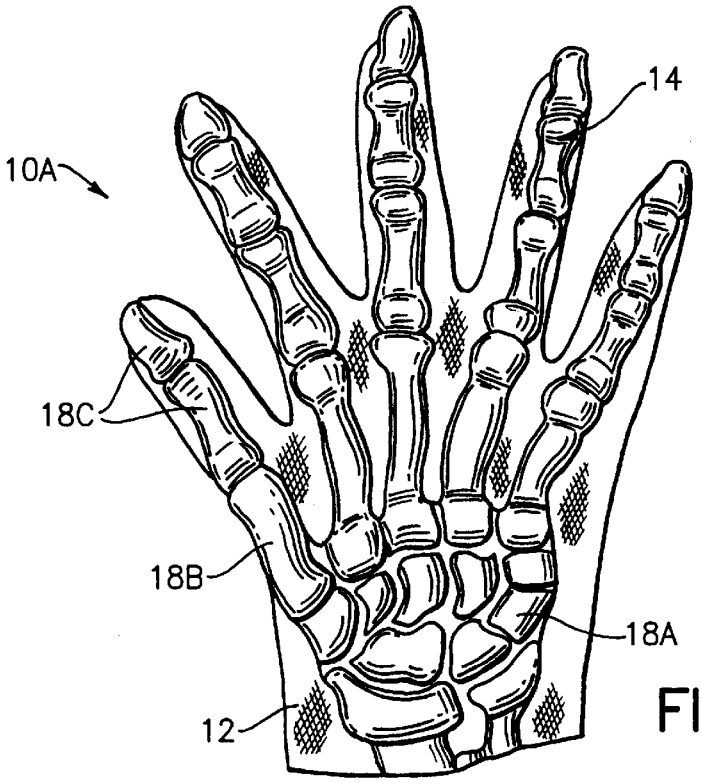
FIG. 2 is similar to FIG. 1 but illustrates a glove costume provided with a different exterior decoration from that shown in FIG. 1 to simulate a desired appearance in the form of a skeleton of a human hand.
Figure 3:
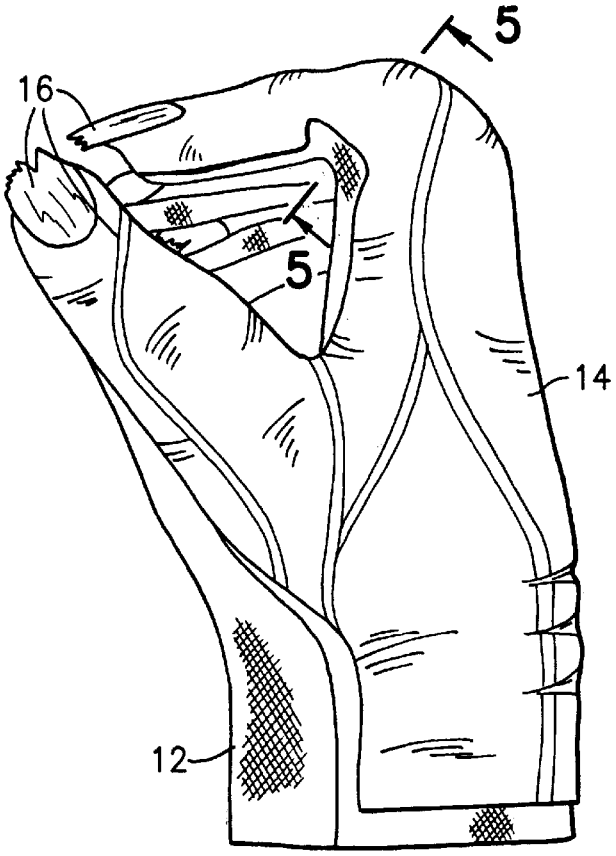
FIG. 3 is a side elevational view of the glove of in FIG. 1, shown in a flexed finger condition.

The specific exterior decoration 16 is not critical for purposes of the present invention and, clearly, numerous such decorations can be used. Thus, in FIG. 1, one example of such exterior decoration 16 can include long, broken nails, protruding veins, unnatural skin texture and/or coloring. In FIG. 2 a further costume glove 10A is illustrated in which the exterior decoration 16A depicts the skeleton of the human hand, including the carpal bones 18A, metacarpal bones 18B and the phalanges 18C.

The first component 12, which consists of the foundation garment, is preferably made of a fabric material. Although any material which is comfortable when in contact with the skin can be used, preferably the material is porous to allow exchange of air and water vapor and allow the body, in this instance the hand, to "breathe," and render the hand comfortable within the costume.

The second component 14, as indicated, is preferably in the form of a molded flexible three-dimensional member which is contoured to at least partially receive and mask a portion of the body. Such molded components can be made of any suitable material. However, in order obtain the advantages of the present invention, the molded component should be made of a thin layer of very flexible material, such as latex, or other soft rubber material. Because such materials can be molded to any desired shapes, the costumes in accordance with the present invention are extremely suitable for the manufacture of Halloween costumes since they can be molded and decorated to simulate the body parts of grotesque and supernatural beings.

In FIGS. 1–5, the first components or foundation garments are typically made of a single member, in this instance a unitary glove that covers the entire hand. As will be described in connection with FIGS. 6–8, a costume in accordance with the present invention may, however, include a separate foundation garment for each major body part, such as the head, the torso, the arms, the legs and/or the hands. Similarly, the second component of a costume in accordance with the present invention may consist of a single member or multiple members. Thus, in FIGS. 1 and 3–5, a single molded flexible three-dimensional 14 member is used to cover the anterior surface of the hand. However, referring to FIG. 2, the present invention also contemplates a plurality of molded flexible three-dimensional members 18A–18C used to cover anterior surface portions of the body, shown as the hand in these figures. Therefore, in FIG. 2 the molded flexible three-dimensional members 18A–18C are shown as a plurality of molded flexible three-dimensional members which, together, cover at least a portion of the anterior surface of the hand. In such an instance, the underlying fabric foundation garment 12 is typically made of a dark color, typically black, so that it is extremely visible, especially at dusk and at night. The representations of the skeleton bones in FIG. 2, in that instance, would typically be colored white so that the contrast would make the bones visible while the foundation garment would not be visible.

Figure 5:
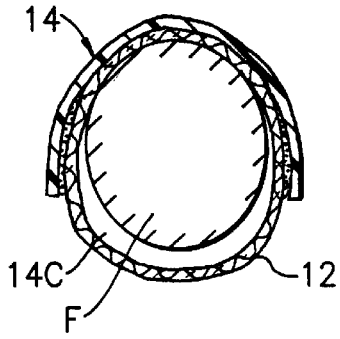
FIG. 5 is similar to FIG. 4, showing a cross sectional view of the glove shown in FIG. 3, taken along line 5—5, to illustrate the relative positions of the component parts of the glove and the finger when the glove is in a partially flexed position.

Although the molded components 18A–18C representing the various portions of the hand skeleton only partially cover anterior surface portions of the hand, at least some or all of such components at least partially receive portions of the hands, such as the depiction in FIGS. 4 and 5, in which the fingers F are at least partially received within the cavities 14*c* formed by the concave surfaces 14*b* to closely follow the external anterior surface of the finger F and thereby have the exterior decoration 16 of the molded components realistically simulate the skin or exterior surface of the hand or other part of the wearer's body.

The specific manner in which the fabric foundation 12 is attached to the flexible molded component is not critical for the purposes of the present invention. A suitable adhesive may be used as the attachment mechanism 17 to attach the enclosed fabric foundation to the concave surface 14*b*. However, because the flexible molded component 14 may not be perfectly flat or smooth, and may be provided with various irregularities to simulate grotesque features, it may be sufficient that the fabric foundation garment 12 be attached to at least selected spots to retain the fabric foundation within the cavity 14*c* formed by the molded component. However, clearly, it may also be possible to attach these two components 12, 14 to each other in other ways, such as by sewing, welding, fusion, etc.

Referring to FIG. 4, it will be appreciated that the costume 10 is most effective when it gives the visual appearance that the entire body portion of the user, here the hand, has the desired appearance or look, although only part of the body is so decorated or masked. In FIG. 4, a coronal plane 24 is shown extending substantially through the center of the finger F, to separate the finger into a front portion F1, which is more proximal, or closer, in the proximal direction 24A, to an observer or viewer 26. The rear portion F2 of the finger is further away from the observer 26 in the posterior direction 24B. Therefore, an observer 26 would normally view the finger F along a line of sight 28 which is generally normal or perpendicular to the coronal plane 24. In order for the observer 26 to have the impression that the wearer is fully surrounded by the molded flexible component 14, it is clear that the latter should cover that part of the finger F between the coronal plane 24 and the observer 26 as well as extend somewhat rearwardly of the coronal plane as shown. In this way the observer 26 cannot normally see where the molded flexible component terminates and is thereby given the impression that the molded member 14 fully surrounds, in this instance, the finger F.

Figure 6:
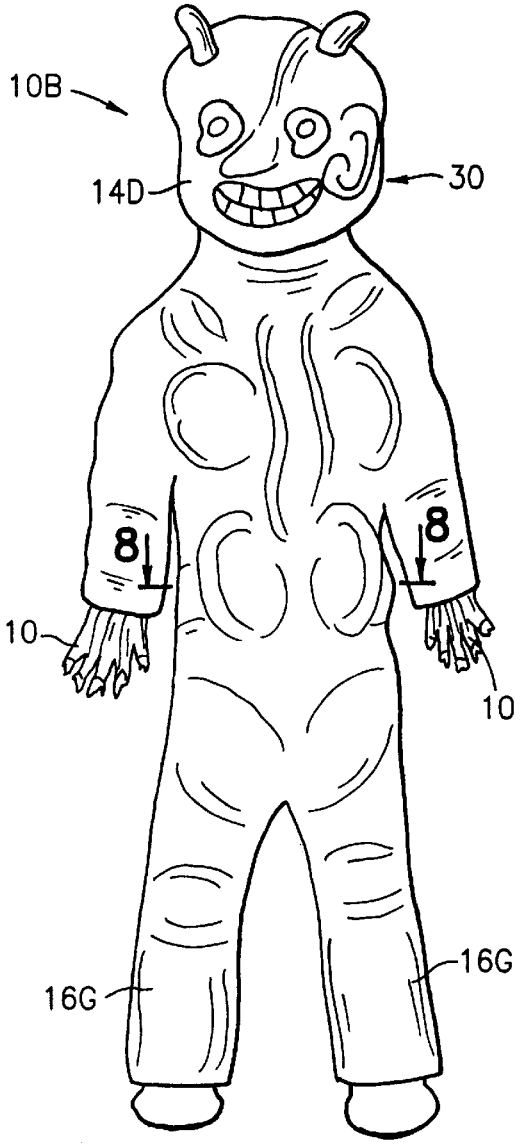
FIG. 6 is a front elevational view of a full body costume in accordance with the present invention.
Figure 7:
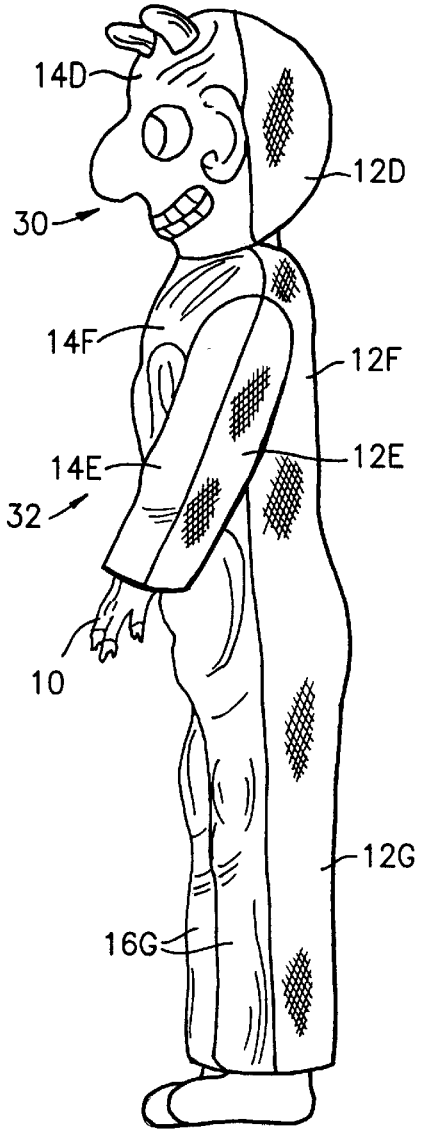
FIG. 7 is a side elevational view of the costume shown in FIG. 6.
Figure 8:
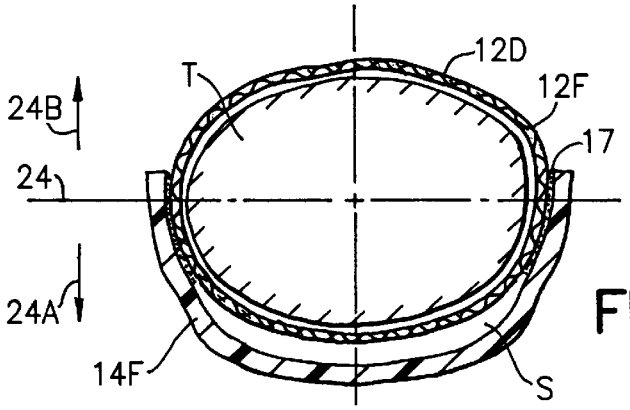
FIG. 8 is a cross sectional view of the costume shown in FIG. 6, taken along line 8—8 in the region of the torso.

Referring to FIGS. 6–8, a multi-component costume 10B is shown which is intended to mask the entire body. With regard to the head, a head component 30 includes a molded flexible three-dimensional face mask 14D that covers the anterior part of the head, namely, the face, such flexible component being secured in some fashion, such as by adhesive, to a fabric foundation 12D. Thus, the head component 30 includes the fabric foundation 12D and the flexible molded component 14D. Each arm may be similarly covered by a fabric foundation 12E which is joined to a molded flexible arm component 14E. The central part of the body or torso can be covered with a body component 32 which includes a torso fabric foundation 12F on the posterior side and a molded flexible component 14F on the anterior side. Also, each of the legs can likewise be masked by fabric foundation portions 12G on the posterior side and molded flexible leg components 16G on the anterior side. In FIG. 8 a cross section of the torso T is shown to illustrate, again, how the molded flexible component 14F covers the torso T along the line of sight or view 28 by covering the torso in front of the coronal plane and extending somewhat beyond or behind such plane while the remaining portion of the torso is only covered by the fabric foundation 12F.

As best shown in FIGS. 4, 5 and 8, the second components or the flexible molded components 14 are preferably slightly oversized to facilitate movements of the wearer's contoured body portion, such as the fingers, arms or legs. Although the plastic and decorated molded components are flexible, the additional spaces S provide additional maneuverability and ability of the user to flex a body member, such as an arm, leg or finger, or extend such a body portion without experiencing a tightness or stiffness.

It will be evident, therefore, that the multi-component costume in accordance with the present invention provides one or more molded flexible three-dimensional members that closely follow the wearer's contoured body portion, such as head, torso, arms, legs or hands, to provide the appearance that the exterior decoration on the flexible molded members corresponds to the exterior surface of the wearer's contoured body portion, while the fabric foundation garment serves to enhance the comfort of the wearer by serving as an intermediate barrier that prevents contact between the skin of the wearer and the molded flexible member. A costume made in accordance with the present invention, therefore, is not only realistic but easy to put on and remove and is comfortable to wear over extended periods of time.

While this invention has been described in detail with particular reference to preferred embodiments thereof, it will be understood that variations and modifications will be effected within the spirit and scope of the invention as described herein and as defined in the appended claims.

What is claimed:

1. A multi-component costume for at least partially masking a contoured anterior portion of the body, comprising a first component consisting of a fabric foundation garment for receiving and substantially fully covering the contoured body portion; a second component consisting of at least one molded flexible three dimensional member configured to at least partially receive and cover or mask an anterior surface of the contoured body portion, said second component defining an external generally convex surface provided with exterior decoration to simulate a desired appearance and an interior generally concave surface forming a three dimensional cavity having a configuration substantially corresponding to a portion of the contoured body intended or desired to be covered or masked; and attachment means for attaching at least a portion of said fabric foundation garment normally covering the contoured body portion intended or desired to be covered or masked to at least one half of said interior generally concave surface, the molded flexible three-dimensional member closely following the wearer's contoured body portion such that the appearance of said exterior decoration corresponds to the exterior surface of the wearer's contoured body portion while said fabric foundation garment serves to enhance the comfort to the wearer by serving as an intermediate barrier that prevents contact between the skin of the wearer and said molded member.

2. A multi-component costume as defined in claim 1, wherein said contoured body portion is the wearer's hand, and said fabric foundation garment comprises a glove.

3. A multi-component costume as defined in claim 2, wherein said molded flexible member includes exterior decoration simulating a skeleton of the hand.

4. A multi-component costume as defined in claim 2, wherein said molded flexible member includes exterior decoration simulating a grotesque hand of a supernatural being.

5. A multi-component costume as defined in claim 1, wherein said foundation garment is made of fabric.

6. A multi-component costume as defined in claim 1, wherein a single molded flexible three-dimensional member is used to cover the anterior surface of the contoured body portion.

7. A multi-component costume as defined in claim 1, wherein a plurality of molded flexible three-dimensional members are used to cover the anterior surface of the contained body portion.

8. A multi-component costume as defined in claim 1, wherein said second component partially covers the anterior surface of the contoured body portion.

9. A multi-component costume as defined in claim 1, wherein said second component fully covers the anterior surface of the contoured body portion, whereby the appearance to an observer positioned in front of the wearer of the costume is that the costume fully surrounds or covers the wearer's body portion.

10. A multi-component costume as defined in claim 1, wherein said contoured body portion is the wearer's head, and said fabric foundation garment is a head pullover that covers the user's anterior and posterior sides of the head.

11. A multi-component costume as defined in claim 1, wherein said contoured body portion is the wearer's arm, and said fabric foundation garment includes a sleeve that covers the arm.

12. A multi-component costume as defined in claim 1, wherein said contoured body portion is the wearer's leg, and said fabric foundation garment comprises pants having a leg covering portion for covering the wearer's leg.

13. A multi-component costume as defined in claim 1, wherein said contoured body portion is the wearer's torso, and said fabric foundation garment comprises a body suit that covers the torso.

14. A multi-component costume as defined in claim 1, wherein said at least one molded flexible three-dimensional member comprises a thin layer of molded rubber.

15. A multi-component costume as defined in claim 14, wherein said molded rubber is latex.

16. A multi-component costume as defined in claim 14, wherein said molded rubber is vinyl.

17. A multi-component costume as defined in claim 1, wherein said first and second components have contrasting colors.

18. A multi-component costume as defined in claim 17, wherein said first component comprises a black fabric foundation garment to reduce its visibility in the dark and to enhance the visibility of said second component.

19. A multi-component costume as defined in claim 1, wherein said attachment means comprises selectively applied adhesive.

20. A multi-component costume as defined in claim 1, wherein said second component is slightly oversized to facilitate movements of the wearer's contoured body portion.

21. A multi-component costume for at least partially masking a contoured anterior portion of the body, comprising a first component consisting of a fabric foundation garment for receiving and substantially fully covering the contoured body portion; a second component consisting of at least one molded flexible three dimensional member configured to at least partially receive and cover or mask an anterior surface of the contoured body portion, said second component defining an external generally convex surface provided with exterior decoration to simulate a desired appearance and an interior generally concave surface forming a three dimensional cavity having a configuration substantially corresponding to a portion of the contoured body intended or desired to be covered or masked and substantially fully covers the anterior surface of the contoured body portion; and attachment means for attaching at least a portion of said fabric foundation garment normally covering the contoured body portion intended or desired to be covered or masked to said interior generally concave surface, the molded flexible three-dimensional member closely following the wearer's contoured body portion such that the appearance of said exterior decoration corresponds to the exterior surface of the wearer's contoured body portion while said fabric foundation garment serves to enhance the comfort to the wearer by serving as an intermediate barrier that prevents contact between the skin of the wearer and said molded member, and wherein the appearance of the costume to an observer positioned in front of the wearer is that the costume fully surrounds or covers the wearer's body portion.

22. A multi-component costume for at least partially masking a contoured anterior portion of the body, comprising a first component consisting of a fabric foundation garment for receiving and substantially fully covering the contoured body portion and including an essentially tubular member forming a closed cross sectional configuration defining a perimeter, a second component consisting of at least one molded flexible three dimensional member configured to at least partially receive and cover or mask an anterior surface of the contoured body portion, said second component defining an external generally convex surface provided with exterior decoration to simulate a desired appearance and an interior generally concave surface forming a three dimensional cavity having a configuration substantially corresponding to a portion of the contoured body intended or desired to be covered or masked, a portion exceeding more than approximately one half of said perimeter being received within said three dimensional cavity; and attachment means for attaching at least a portion of said fabric foundation garment normally covering the contoured body portion intended or desired to be covered or masked to said interior generally concave surface, the molded flexible three-dimensional member closely following the wearer's contoured body portion such that the appearance of said exterior decoration corresponds to the exterior surface of the wearer's contoured body portion while said fabric foundation garment serves to enhance the comfort to the wearer by serving as an intermediate barrier that prevents contact between the skin of the wearer and said molded member.

23. A multi-component costume as defined in claim 22, wherein at least one half of said perimeter is received within said three dimensional cavity.

* * * * *